US012178364B1

(12) United States Patent
Calahan

(10) Patent No.: US 12,178,364 B1
(45) Date of Patent: Dec. 31, 2024

(54) HYGIENIC COVER ENSEMBLE FOR A TOILET

(71) Applicant: Kassie Alison Calahan, Hamilton, OH (US)

(72) Inventor: Jeffrey Calahan, Cincinnati, OH (US)

(73) Assignee: Kassie Alison Calahan, Hamilton, OH (US)

( * ) Notice: Subject to any disclaimer, the term of this patent is extended or adjusted under 35 U.S.C. 154(b) by 0 days.

(21) Appl. No.: 18/590,305

(22) Filed: Feb. 28, 2024

Related U.S. Application Data

(60) Provisional application No. 63/590,590, filed on Oct. 16, 2023.

(51) Int. Cl.
*A47K 13/14* (2006.01)

(52) U.S. Cl.
CPC ..... *A47K 13/14* (2013.01)

(58) Field of Classification Search
CPC ..... A47K 1/06; A47K 11/00–0035; A47K 11/04–08; A47K 13/005; A47K 13/06; A47K 13/14–16; A47K 13/18; A47K 13/22; A47K 13/24; A47K 13/242; A47K 13/26; A47K 17/00; A47K 17/026; A47K 3/002; A61H 33/0087; E03C 1/181; E03C 1/186; E03D 1/006; E03D 11/00; E03D 11/125; E03D 11/13; E03D 13/005; E03D 7/00; E03D 9/08; G09F 23/06; Y10S 4/00; Y10S 4/05; Y10S 4/18; Y10S 4/901–902
USPC ..... 4/416, 661, 901, DIG. 5; D23/298, D23/310–313
See application file for complete search history.

(56) References Cited

U.S. PATENT DOCUMENTS 3,087,524 A * 4/1963 Dolnick ..... E03D 1/01 D6/610
3,408,661 A * 11/1968 Hammond ..... A47K 13/24 428/181
3,566,414 A * 3/1971 Basner ..... A47K 17/00 4/300
5,067,185 A * 11/1991 Kohler ..... A47K 13/16 4/DIG. 18
6,119,282 A * 9/2000 Serbin ..... A47K 13/24 4/300.3

(Continued)

FOREIGN PATENT DOCUMENTS

JP 2018178530 * 11/2018 ..... A47K 17/02
JP 2021141967 * 9/2021 ..... A47K 17/02

*Primary Examiner* — David P Angwin
*Assistant Examiner* — Nicholas A Ros
(74) *Attorney, Agent, or Firm* — Wood Herron & Evans LLP

(57) ABSTRACT

A hygienic cover ensemble for a toilet is disclosed. The hygienic cover ensemble includes a bowl skirt configured to be removably attached to a bowl of the toilet and a tank skirt configured to be removably received over the water tank of the toilet. The tank skirt includes an opening to receive a flush mechanism of the toilet. The bowl skirt includes a rim cover that includes an absorbent core and is configured to extend completely about so as to cover a rim of the bowl of the toilet. The bowl skirt includes a bowl cover that extends loosely about a front of the bowl and includes a fastener configured to removably secure the bowl cover to the front of the bowl. The bowl skirt includes a pair of attachment flaps that are configured to overlap and connect to removably attach the bowl skirt to the toilet.

19 Claims, 7 Drawing Sheets

(56) References Cited

U.S. PATENT DOCUMENTS

| | | | | |
|---|---|---|---|---|
| 6,223,632 | B1 * | 5/2001 | Johnson | B25B 13/16 81/169 |
| 8,719,972 | B1 * | 5/2014 | Baker | A47K 17/00 4/300.3 |
| 9,903,104 | B2 * | 2/2018 | Welliver | E03D 11/13 |
| 10,494,802 | B1 * | 12/2019 | Kolesar | E03D 9/00 |
| D1,016,259 | S * | 2/2024 | Cordova | D23/311 |
| 2002/0112280 | A1 * | 8/2002 | Christmas | A47K 13/24 4/242.1 |
| 2016/0324378 | A1 * | 11/2016 | Padar | A47K 11/105 |
| 2021/0022569 | A1 * | 1/2021 | Burrup | A47K 13/16 |
| 2021/0369063 | A1 * | 12/2021 | Drummer | E03D 9/00 |

* cited by examiner

HYGIENIC COVER ENSEMBLE FOR A TOILET

CROSS-REFERENCE TO RELATED APPLICATION

The present application claims the filing benefit of U.S. Provisional Application Ser. No. 63/590,590, filed Oct. 16, 2023, the disclosure of which is incorporated herein by reference in its entirety.

TECHNICAL FIELD

The present invention relates generally to toilets, and more particularly to a toilet cover ensemble to protect a toilet from the soiling effects of everyday use.

BACKGROUND

Toilets are indispensable fixtures in modern society, serving as essential elements of sanitation and personal hygiene. Conventional toilets, as commonly found in households and public facilities, typically consist of a bowl, a water tank, a flush mechanism, a seat, and a cover. While toilets have effectively met the fundamental requirements of waste disposal and hygiene, they are not without limitations.

One limitation is that the nature of toilet use inevitably leads to the accumulation of dirt, stains, and potentially harmful bacteria within and around the toilet. This necessitates regular and thorough cleaning, often requiring the scrubbing of crevices and other hard-to-reach places about the toilet; a task that is not only time-consuming but also often requires the use of chemical agents, contributing to environmental concerns.

Another limitation is that conventional toilets typically exhibit a rather mundane and unexciting appearance. Their utilitarian design, often devoid of aesthetic appeal, hardly complements the overall ambiance of modern interiors. This lack of aesthetic consideration has left many users dissatisfied with the visual aspect of their bathroom fixtures, and bathroom interiors generally.

In view of the above, there is a need for a product that not only reduces the manual labor and time involved in maintaining toilet cleanliness but also elevates the aesthetic appeal of the toilet itself. In particular, there is a need for a hygienic cover ensemble that not only enhances toilet hygiene and user satisfaction but also contributes to the overall visual appeal of the bathroom environment.

SUMMARY

According to an embodiment of the present invention, a hygienic cover ensemble for covering parts of a toilet during use is disclosed. The hygienic cover ensemble includes a bowl skirt, otherwise referred to as the "Bowl Buddy," that is configured to be removably attached to a bowl of the toilet and a separate tank skirt, otherwise referred to as the "Tank Topper," that is configured to be removably received over the water tank of the toilet. The bowl skirt includes a rim cover configured to extend completely about so as to cover a rim of the bowl of the toilet. In that regard, a portion of the rim cover includes an absorbent core. The bowl skirt also includes a bowl cover that extends downwardly from a perimeter of the rim cover so as to extend loosely about a front portion of the bowl of the toilet. The bowl cover includes an open back to expose a back side of the bowl and a fastener configured to removably secure a portion of the bowl cover to a front of the bowl. The bowl cover includes a pair of attachment flaps spaced from the rim cover. The pair of attachment flaps are configured to overlap and cover a rear portion of the rim between a lid assembly and a water tank of the toilet. In particular, the pair of attachment flaps are configured to overlap in a lengthwise direction to removably attach the bowl skirt to the toilet. At least one of the pair of attachment flaps includes a pull tab. The tank skirt includes a top sheet configured to engage a lid of the water tank and a side sheet that extends downwardly from a perimeter of the top sheet to an open end so as to extend loosely about the water tank. The side sheet includes an opening to receive a flush mechanism of the toilet therethrough.

According to another embodiment of the present invention, a hygienic cover ensemble for covering parts of a toilet is disclosed. The hygienic cover ensemble includes a tank skirt configured to encircle a water tank of the toilet and a bowl skirt configured to removably envelop a bowl of the toilet. In that regard, the bowl skirt includes a rim cover that is configured to cover a rim of the bowl of the toilet, a bowl cover that extends downwardly from a perimeter of the rim cover to cover a front portion of the bowl of the toilet, and at least one attachment flap spaced from the rim cover. The at least one attachment flap is connected to the bowl cover for rotation relative to the bowl cover. The at least one attachment flap is configured to removably secure the bowl skirt to the toilet.

According to one aspect, the at least one attachment flap includes a pair of attachment flaps that may be configured to overlap in a lengthwise direction to cover a rear portion of the rim between a lid assembly and the water tank of the toilet. In that regard, a slot may be formed between the pair of connected attachment flaps and the bowl cover is formed. The slot is configured to accommodate a lid assembly of the toilet.

In another aspect, the bowl skirt may include a fastener that is configured to removably secure a portion of the bowl skirt to the bowl of the toilet. For example, the fastener may be positioned on the bowl cover to removably secure a portion of the bowl cover to the front portion of the bowl of the toilet. According to another aspect, the bowl cover may include an open back to expose a back of the bowl of the toilet.

In yet another aspect, a portion of the rim cover may include an absorbent core. For example, the absorbent core may extend circumferentially about 50% or more about an inner edge of the rim cover. The absorbent core may also terminate at a pair of ends adjacent a base edge of the rim cover. Furthermore, the at least one attachment flap may also include an absorbent core.

According to one aspect, the bowl skirt or the tank skirt may include one or more indicia, such as graphical indicia, logo indicia, or other design indicia. In another aspect, the bowl skirt and the tank skirt may be reusable. In yet another aspect, the at least one attachment flap may include a pull tab. The tank skirt may include an opening to receive a flush mechanism of the toilet therethrough.

According to another embodiment of the present invention, a bowl skirt that is configured to removably envelop a bowl of a toilet is disclosed. The bowl skirt includes a rim cover that is configured to extend completely about so as to cover a rim of the bowl of the toilet, a bowl cover that extends downwardly from a perimeter of the rim cover so as to extend about a front portion of the bowl of the toilet, and a pair of attachment flaps spaced from the rim cover. The pair of attachment flaps are each hingeably connected to the bowl cover and are configured to overlap and connect to each other to removably secure the bowl skirt to the toilet. The pair of attachment flaps are configured to overlap in a lengthwise direction to cover a rear portion of the rim between a lid assembly and a water tank of the toilet.

According to one aspect, a portion of the rim cover may include an absorbent core. For example, the absorbent core may extend circumferentially about 50% or more about an inner edge of the rim cover. Additionally, the absorbent core may terminate at a pair of ends adjacent a base edge of the rim cover. In another aspect, each of the pair of attachment flaps may include an absorbent core. In yet another aspect, the bowl cover may include one or more indicia.

Additional features and advantages will be set forth in the detailed description which follows, and in part will be readily apparent to those skilled in the art. It is to be understood that the foregoing general description, the following detailed description, and the accompanying drawings are merely exemplary and intended to provide an overview or framework to understand the nature and character of the claims.

BRIEF DESCRIPTION OF THE DRAWINGS

The accompanying drawings, which are incorporated in and constitute a part of this specification, illustrate one or more embodiments of the invention and, together with the general description given above and the detailed description given below, serve to describe the one or more embodiments of the invention. Features and attributes associated with any of the embodiments shown or described may be applied to other embodiments shown, described, or appreciated based on this disclosure.

DETAILED DESCRIPTION

Embodiments of the present invention are directed to a hygienic cover ensemble for a toilet, such as a toilet that would be commonly found in households and public facilities, for example. The hygienic cover ensemble includes a bowl cover, otherwise referred to as the "Bowl Buddy," for covering parts of the toilet bowl and a tank cover, otherwise referred to as the "Tank Topper," for covering parts of the water tank of the toilet. In that regard, the hygienic cover ensemble is a 2-piece assembly. The hygienic cover ensemble is configured to serve at least the following two functions.

First, the hygienic cover ensemble is configured to protect the toilet from the effects of everyday soiling by remaining on the toilet during use. This prevents surfaces of the toilet, such as the external surfaces, from becoming soiled, thereby reducing the amount of manual labor and time required to clean the toilet. Instead, the hygienic cover ensemble becomes soiled. The hygienic cover ensemble may be occasionally removed and washed for cleaning. In that regard, the toilet surfaces that were covered by the hygienic cover ensemble only require minimal cleaning, such as a quick wipe down. Parts of the hygienic cover ensemble may be hand-washed or machine-washed, for example. Once cleaned, the hygienic cover ensemble may be reinstalled on the toilet. In one embodiment, the hygienic cover ensemble is reusable.

Second, the hygienic cover ensemble is configured to improve the aesthetic appearance of the toilet. For example, the bowl cover and tank cover may include patterns, branding, or logos, such as a sports team logo, to make the toilet and bathroom more visually appealing. The hygienic cover ensemble may be paired with a shower curtain, shower and/or sink rug, towels, and/or other items in the bathroom to improve its overall ambiance. To this end, the hygienic cover ensemble may be desirable for use in household bathrooms (e.g., a mancave or main bathroom), hotel, or event center bathrooms, for example. These and other benefits of the invention will be described in more detail below.

Figure 1:
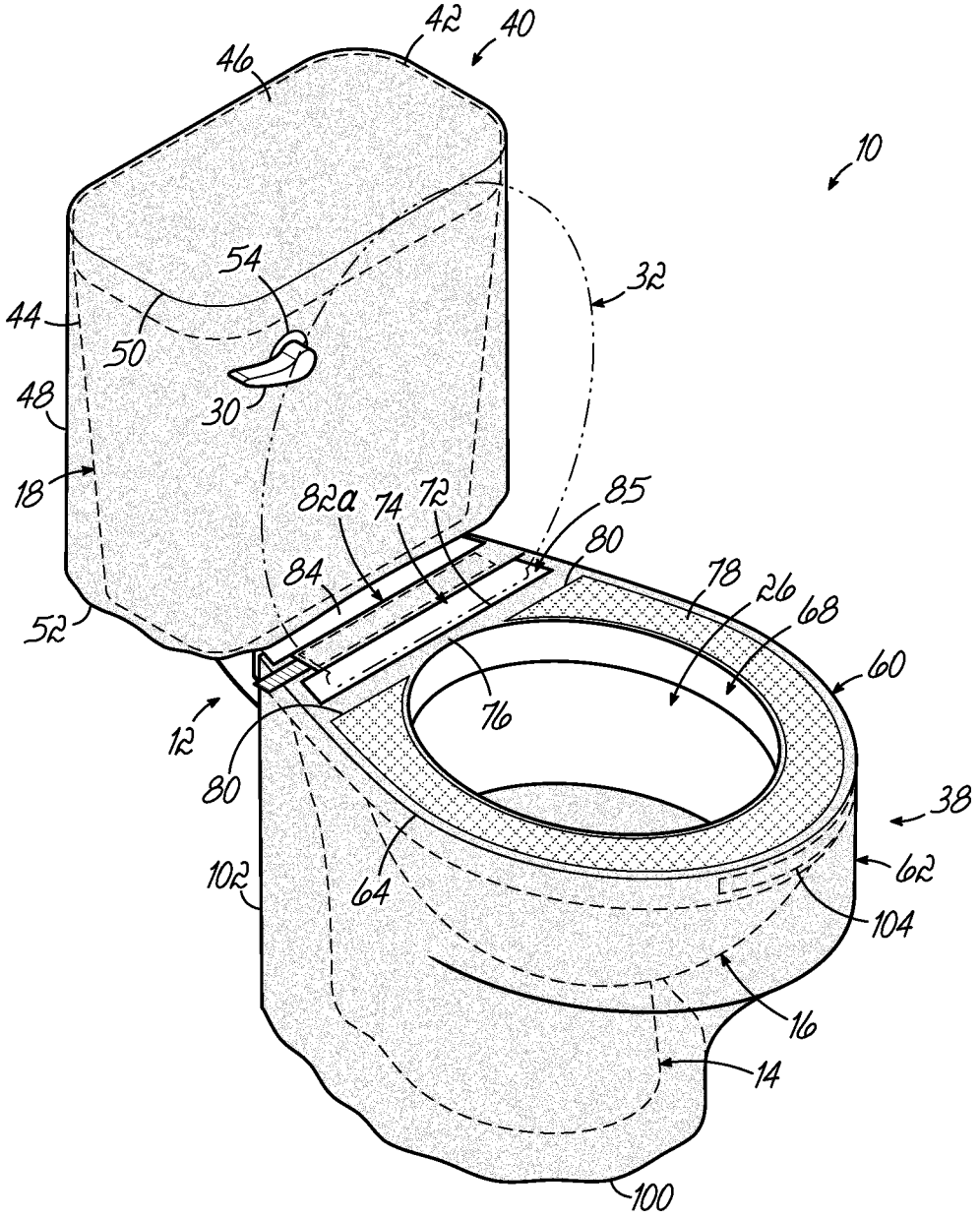
FIG. 1 is a front perspective view of a bowl skirt and a tank skirt of a hygienic cover ensemble installed on a toilet in accordance with an embodiment of the present invention.
Figure 2:
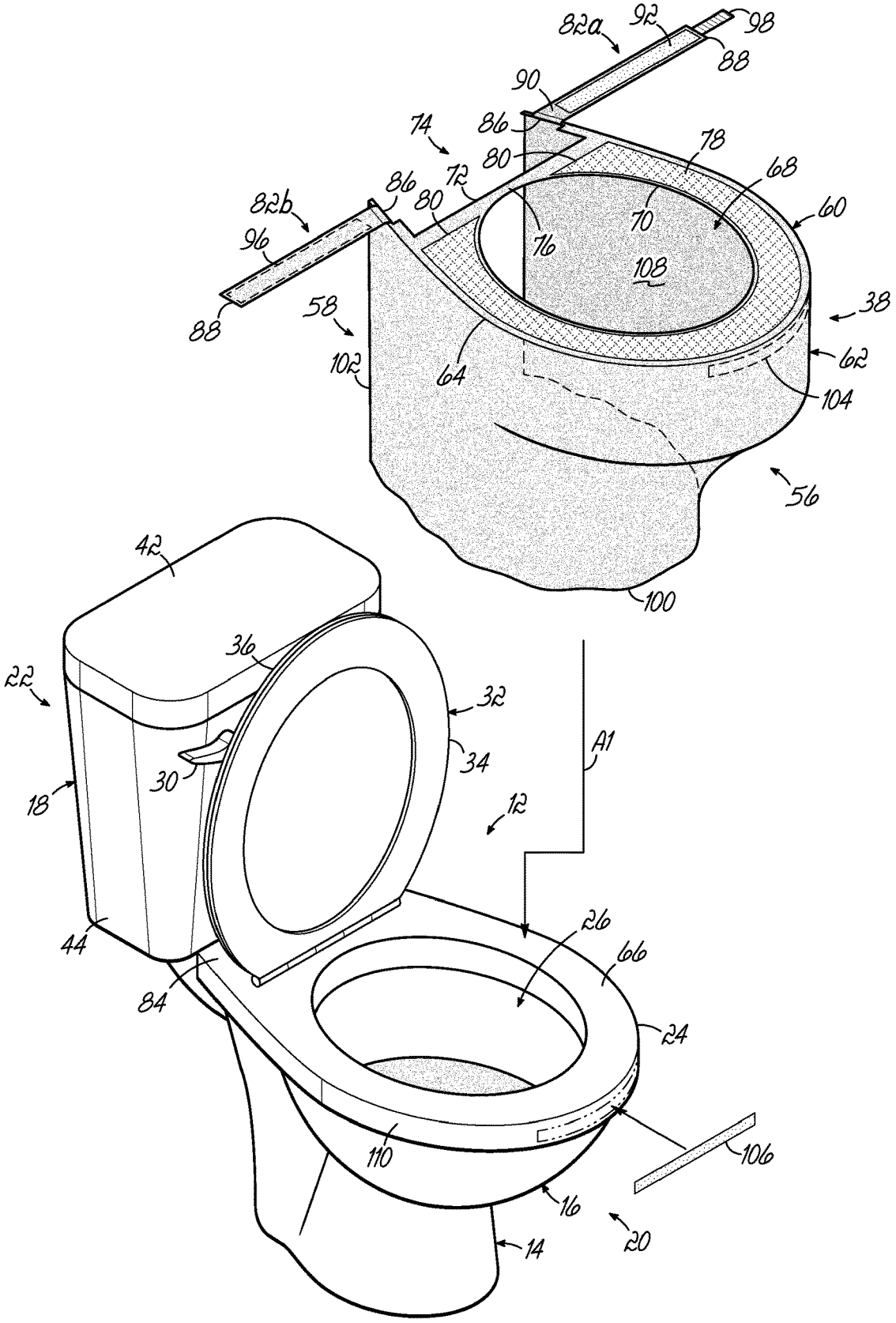
FIG. 2 is a front perspective view of the bowl skirt of FIG. 1, illustrating installation of the bowl skirt to the toilet.
Figure 3:
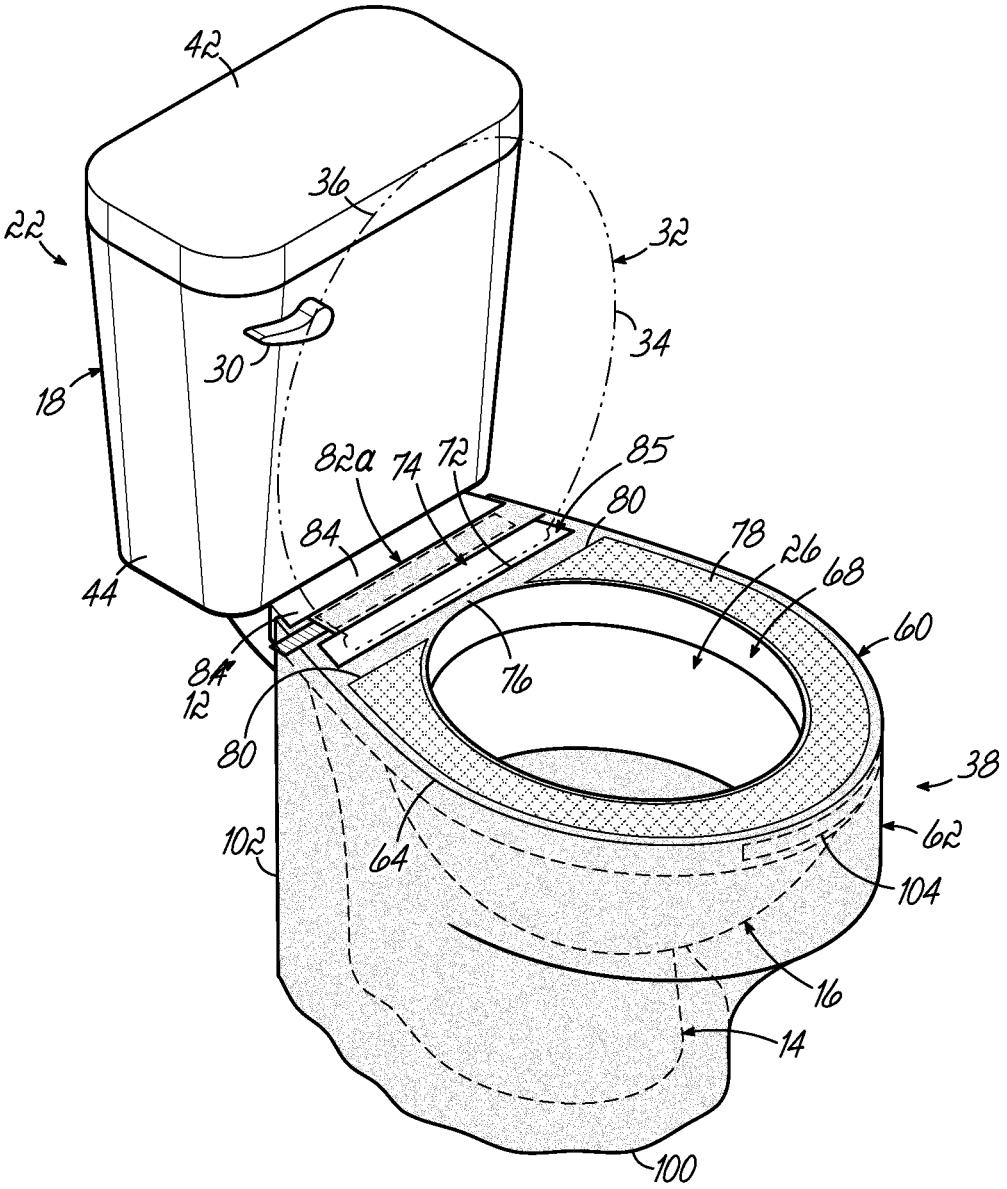
FIG. 3 is a front perspective view of the bowl skirt of FIGS. 1-2C installed to the toilet.

Referring now to the figures, FIGS. 1-3 illustrate a hygienic cover ensemble 10 that is configured to be installed to a toilet 12 in accordance with an embodiment of the present invention. The toilet 12 may be a conventional toilet, such as those commonly found in households and public facilities. As best shown in FIG. 2, the toilet 12 includes a pedestal 14, a bowl 16, and a water tank 18. The toilet 12 includes a front 20 that typically faces the user and a back 22 that typically faces a wall or other surface against which the toilet 12 may be positioned. The bowl 16 extends upward from the pedestal 14 to a rim 24 that surrounds an opening 26 to the bowl 16. The bowl 16 is configured to receive clean water from the tank 18 and is configured to receive human waste via the bowl opening 26. The toilet 12 includes a handle 30 that is operatively connected to a flushing mechanism (not shown) that discharges the water-waste mixture from the bowl 16 to a connected plumbing system (not shown). The toilet 12 also includes a lid assembly 32 that includes at least a toilet seat 34 and cover 36. Parts of the toilet 12 are typically constructed of ceramic, porcelain, plastic, or other durable and easy-to-clean materials.

With reference to FIG. 1, the hygienic cover ensemble 10 includes a bowl skirt 38 configured to removably envelop the bowl 16 of the toilet 12 and a tank skirt 40 that is configured to be removably encircle the water tank 18 of the toilet 12. The bowl skirt 38 may be removably attached to the bowl 16 of the toilet 12 and the tank skirt 40 may be removably received over the water tank 18, as will be described in further detail below. Together, the bowl skirt 38 and the tank skirt 40 form the hygienic cover ensemble 10. The tank skirt 40 is configured to cover the water tank 18. Specifically, the tank skirt 40 is configured to be removably received over the tank 18 so as to cover at least a lid 42 and a sidewall 44 of the water tank 18. The tank skirt 40 includes a top sheet 46 and a side sheet 48 that extends downwardly from a perimeter 50 of the top sheet 46 to define an open end 52 of the tank skirt 40. As shown in FIG. 1, tank skirt 40 is received over the water tank 18 such that the top sheet 46 engages the lid 42 of the water tank 18. The side sheet 48 extends loosely about the sidewall 44 of the water tank 18. When received over the water tank 18, the open end 52 of the tank skirt 40 may be generally adjacent the rim 24 of the toilet bowl 16, for example. The tank skirt 40 also includes an opening 54 to accommodate the handle 30 of the flush mechanism, allowing the handle 30 to remain accessible after the tank skirt 40 is installed. As shown, the handle 30 is configured to be received through the opening 54 in the tank skirt 40.

In the embodiment shown, the material of construction of the tank skirt 40 is natural fiber, such as cotton, bamboo, or linen, so that the tank skirt 40 may be washable and reusable, particularly with minimal to no size shrinkage. The material of construction may include antimicrobial properties to help prevent the growth of bacteria and other microorganisms, for example. However, in another embodiment, the tank skirt 40 may be manufactured from other materials, such as plastic, polyester, vinyl, polyethylene vinyl acetate (PEVA), or polyvinyl chloride (PVC), for example. In one embodiment, the tank skirt 40 may be configured as a single-use item and disposed of after use, and may be constructed of a paper material.

Referring now to FIGS. 1 and 2, the bowl skirt 38 is configured to be removably attached to the bowl 16 so as to cover a majority of the exterior surfaces of the bowl 16 and the pedestal 14 of the toilet 12. In particular, the bowl skirt 38 is configured to engage and cover the rim 24 or the toilet seat 34 while a remainder of the bowl skirt 38 drapes down and covers a portion of the pedestal 14 and the bowl 16 of the toilet 12. The bowl skirt 38 includes a front 56 that is configured to be positioned adjacent the front 20 of the toilet 12 and a back 58 that is configured to be positioned adjacent the back 22 of the toilet 12. As shown, the bowl skirt 38 includes a rim cover portion 60 (otherwise referred to as "rim cover 60") that forms a top of the bowl skirt 38 and a bowl cover portion 62 (otherwise referred to as "bowl cover 62") that extends downward from a peripheral edge 64 of the rim cover portion 60. The rim cover portion 60 extends completely about the bowl opening 26 when the bowl skirt 38 is installed to the toilet 12. In particular, the rim cover portion 60 is sized to cover a majority of a top surface 66 of the rim 24 (or the toilet seat 34) that encircles the bowl opening 26. For example, the rim cover portion 60 may cover 90% or more of the top surface 66 of the rim 24 (or the toilet seat 34). In one embodiment, the rim cover portion 60 may cover the entirety of the top surface 66 of the rim 24 (or the toilet seat 34).

The rim cover portion 60 includes a central opening 68 that is defined by an inner edge 70 of the rim cover portion 60. The rim cover portion 60 extends between the inner edge 70, the peripheral edge 64, and a base edge 72, to define a width of the rim cover portion 60. As best shown in FIG. 2, the rim cover portion 60 includes a notch 74 to accommodate the lid assembly 32. The notch 74 defines the base edge 72 of the rim cover portion 60. The width of the rim cover portion 60 may be the narrowest in a region that extends along the base edge 72 to define a strip 76 that covers a small area of the top surface 66 of the rim 24 that is between the lid assembly 32 and the bowl opening 26. This strip 76 provides the rim cover portion 60 as a single piece of material that extends continuously in an unbroken manner about the top surface 66 of the rim 24. To that end, the width of the rim cover portion 60 generally corresponds to a size of the exposed top surface 66 of the rim 24 that surrounds or encircles the bowl opening 26.

Figure 2A:
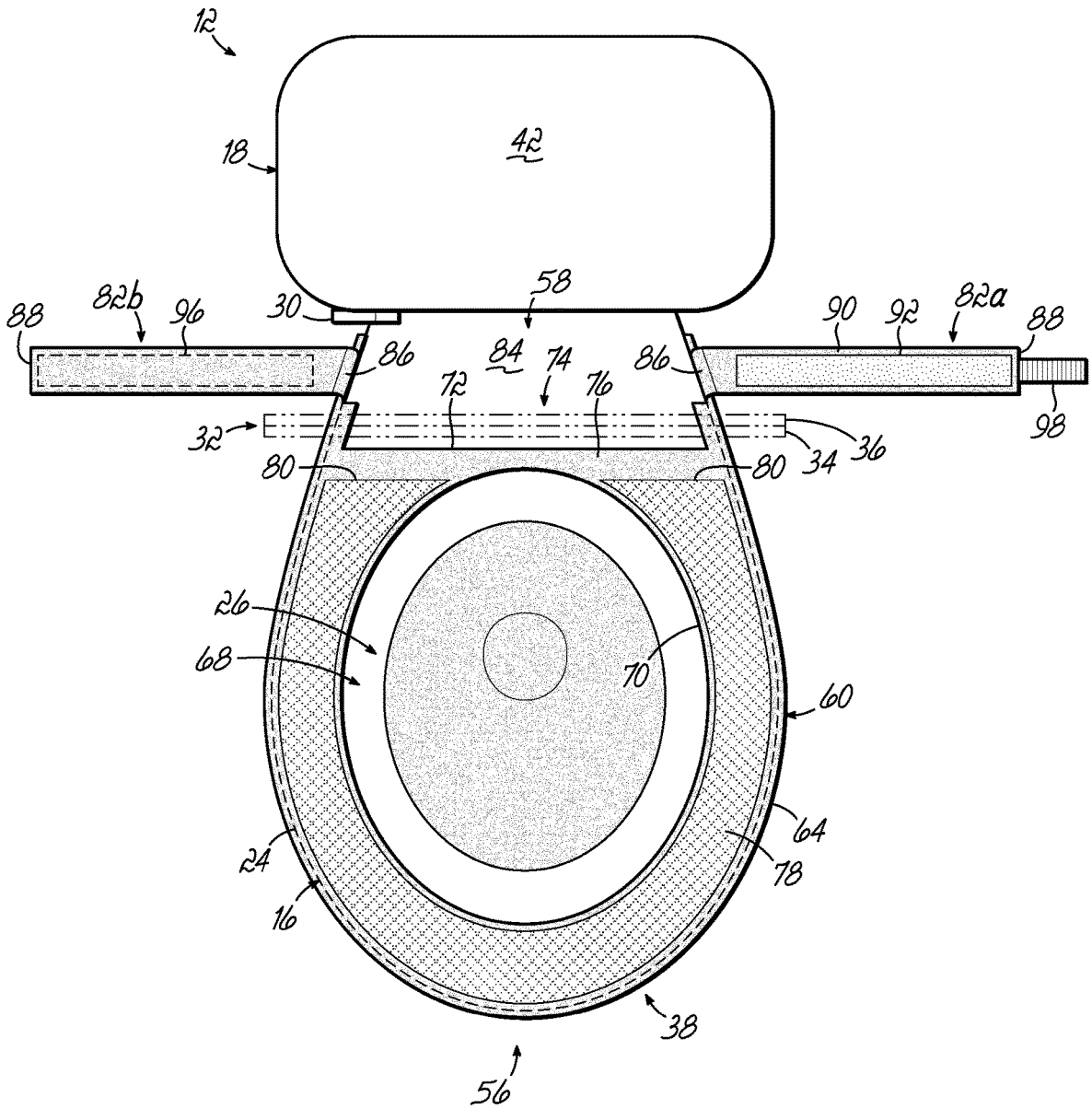
FIGS. 2A-2C are top views of the bowl skirt of FIGS. 1 and 2, further illustrating installation of the bowl skirt to the toilet.

With reference to FIGS. 1-2A, the rim cover portion 60 of the bowl skirt 38 includes an absorbent core 78 that is configured to wick or absorb fluids that would otherwise land on the rim 24 of the toilet bowl 16. The absorbent core 78 prevents the rim cover portion 60 from becoming oversaturated and leaking fluids elsewhere, such as onto the bowl cover 62, for example. The absorbent core 78 may be integrated between layers of the rim cover portion 60 or attached to the outermost layer. The absorbent core 78 may also have antimicrobial properties to help prevent the growth of bacteria and other microorganisms, and the associated odor. The absorbent core 78 may be formed of microfiber, polyester, or bamboo, superabsorbent polymers (SAPs), cellulose, polypropylene, charcoal, or any combination thereof, for example.

As shown in FIG. 2A, the absorbent core 78 is generally C-shaped, and extends about a portion of the rim cover portion 60. In particular, the absorbent core 78 extends from a pair of ends 80 adjacent the base edge 72 of the rim cover portion 60 such that a majority of the rim cover portion 60 includes the absorbent core 78. For example, the absorbent core 78 may extend circumferentially about 50% or more about the inner edge 70 of the rim cover 60. As shown, the absorbent core 78 may extend circumferentially about 80% or more about the inner edge 70 of the rim cover 60. The strip 76 of the rim cover portion 60 may not include any absorbent core 78, as shown. The absorbent core 78 may have a width (measured in a direction between the peripheral edge 64 and the inner edge 70 of the rim cover portion 60) that is equal to 90% or more of the width of the rim cover portion 60, as shown. The width of the absorbent core 78 may widen at the ends 80 to cover the widening profile of the top surface 66 of the rim 24.

With continued reference to FIGS. 1-2A, the bowl skirt 38 further includes a pair of attachment flaps 82*a*, 82*b* spaced from the base edge 72 of the rim cover portion 60. The pair of attachment flaps 82*a*, 82*b* includes a first attachment flap 82*a* that is removably attachable to a second attachment flap 82*b* via a shared connection means. The attachment flaps 82*a*, 82*b* engage in the space defined by the notch 74. In particular, the first attachment flap 82*a* is configured to overlay and couple to the second attachment flap 82*b* to removably secure the bowl skirt 38 to the toilet bowl 12. As shown in FIG. 1, the pair of attachment flaps 82*a*, 82*b* overlap and cover a rear portion 84 of the rim 24 between the lid assembly 32 and the water tank 18. When connected, the pair of attachment flaps 82*a*, 82*b* close the notch opening 74 to define a slot or opening 85 that accommodates the lid assembly 32, and in particular the hinged connection of the lid assembly 32 to the rim 24 of the toilet 12. To that end, the slot 85 is an opening between the base 72 of the rim cover portion 60 and the coupled attachment flaps 82*a*, 82*b*.

With reference to FIG. 2A, each attachment flap 82*a*, 82*b* is located adjacent to the back 58 of the bowl skirt 38 and is formed of a strip of material that extends in a lengthwise direction from a hinged connection point 86 adjacent the peripheral edge 64 of the rim cover 60 to a distal end 88. Thus, each attachment flap 82*a*, 82*b* is hingeably connected to the bowl cover 62. Each attachment flap 82*a*, 82*b* includes a length measured between the hinged connection point 86 and the distal end 88. The length of each attachment flap 82*a*, 82*b* may be 10 inches, for example. Each attachment flap 82*a*, 82*b* may have a width of 3 inches, for example. The attachment flaps 82*a*, 82*b* may also include an absorbent core to capture fluids that that make their way behind the lid assembly 32.

Figure 2B:
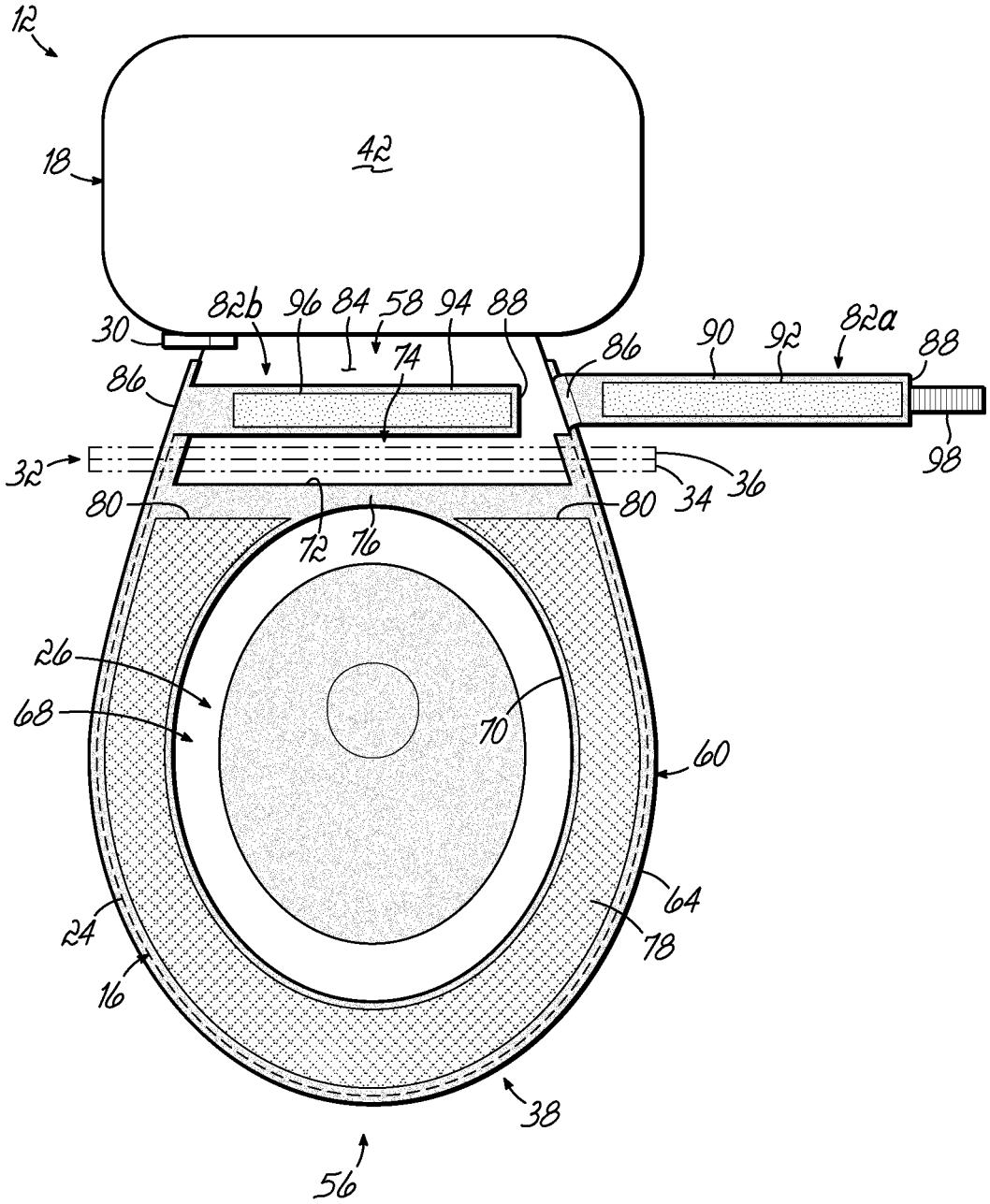

The attachment flaps 82*a*, 82*b* are configured to overlap in a lengthwise direction to removably attach the bowl skirt 38 to the toilet 12. In that regard, the attachment flaps 82*a*, 82*b* include a connection means to removably secure the attachment flaps 82*a*, 82*b* together once overlaid. In the embodiment shown, the attachment means is in the form of a hook-and-loop fastening system (often referred to as Velcro®). As shown, in FIG. 2A, a bottom surface 90 of the first attachment flap 82*a* may include a strip 92 of small hooks or bristles, for example. As shown in FIG. 2B, a top surface 94 of the second attachment flap 82*b* may include a corresponding strip 96 of loops of soft, flexible material, for example. When overlaid, the strips 92, 96 couple the attachment flaps 82*a*, 82*b* together. Each strip 92, 96 may extend for 80% or more of the length of the corresponding attachment flap 82*a*, 82*b*, respectively. The distal end 88 of the first attachment flap 82*a* may include a pull tab 98 to facilitate decoupling of the attachment flaps 82*a*, 82*b* to remove the bowl skirt 38 from the toilet 12.

Returning to FIGS. 1 and 2, the bowl skirt 38 further includes the bowl cover portion 62, as briefly described above. The bowl cover portion 62 extends downwardly from the peripheral edge 64 of the rim cover portion 60 to define an open end 100 and an open back 102 of the bowl skirt 38. As shown in FIG. 1, the bowl cover portion 62 is generally tapered to the shape of the bowl 16 and the pedestal 14 of the toilet 12. The bowl portion 62 may include one or more seams to achieve the tapered shape. The bowl portion 62 may be in close proximity to the bowl 16 and the pedestal 14 of the toilet 12. In that regard, the bowl portion 62 may extend loosely about the front 20 of the bowl 16 of the toilet 12. Stated differently, the bowl cover portion 62 hangs from the rim 24 of the toilet 12 such that a majority of the bowl cover portion 62 may not contact the bowl 16 and the pedestal 14, for example. The bowl cover portion 62 does not extend completely around the toilet 12. Rather, the open back 102 exposes a rear of the pedestal 14 and the bowl 16 of the toilet 12, which typically is not exposed to the soiling effects of everyday use of the toilet 12. When the bowl skirt 38 is installed to the toilet 12, the open end 100 may be generally adjacent the floor or surface on which the toilet 12 sits.

With continued reference to FIGS. 1 and 2, the bowl skirt 38 includes a fastener for removably attaching the bowl skirt 38 to the toilet 12. In the embodiment shown, the fastener forms part of a hook-and-loop fastening system (often referred to as Velcro®). In that regard, the bowl cover portion 62 includes the fastener which is in the form of an attachment strip 104 that is configured to engage a second attachment strip 106 located on the toilet 12 to secure the bowl cover portion 62 to the toilet 12. In the embodiment shown, the first attachment strip 104 may be a strip of small hooks or bristles, for example. The second attachment strip 106 may include a corresponding strip of loops of soft, flexible material, for example.

As shown in FIG. 2, the first attachment strip 104 is located on an interior surface 108 at the front 56 of the bowl cover portion 62. In particular, the first attachment strip 104 is positioned near the rim cover portion 60. The first attachment strip 104 may be sewn to the bowl cover portion 62, for example. The first attachment strip 104 is configured to engage the second attachment strip 106, which is located at the front 20 of the toilet 12 and on a side surface 110 of the rim 24. The second attachment strip 106 may be adhered to the side surface 110 of the rim 24, for example. The connection between the first and second attachment strips 104, 106 keeps the bowl skirt 38 in place on the toilet 12 so that it does not shift during use. Additionally, the connection prevents the bowl skirt 38 from being accidentally pulled off the toilet 12, such as when someone accidentally steps on the bowl cover portion 62, for example. Each attachment strip 104, 106 may be 12 inches long, for example. However, a length or number of attachment strips 104, 106 may be varied as desired.

In an alternative embodiment, the first attachment strip 104 may be replaced with a small slit sewn into the bowl cover portion 62. The second attachment strip 106 may be replaced with an S-shaped clip that is configured to clip onto the front 20 of the toilet rim 24. The slit is configured to fit over the end of the S-shaped clip, so that the bowl skirt 38 may be supported from the front 20 of the toilet 12. The S-shaped clip may be removed from the toilet 12 and cleaned with the bowl skirt 38.

In the embodiment shown, the material of construction of the bowl skirt 38 is natural fiber, such as cotton, bamboo, or linen, so that the bowl skirt 38 may be washable and reusable, particularly without shrinkage in size. The material of construction may include antimicrobial properties to help prevent the growth of bacteria and other microorganisms, for example. However, in another embodiment, the bowl skirt 38 may be manufactured from other materials, such as plastic, polyester, vinyl, polyethylene vinyl acetate (PEVA), or polyvinyl chloride (PVC), for example. In one embodiment, the bowl skirt 38 can be configured as a single-use item and disposed of after use, and may be constructed of a paper material.

Figure 2C:
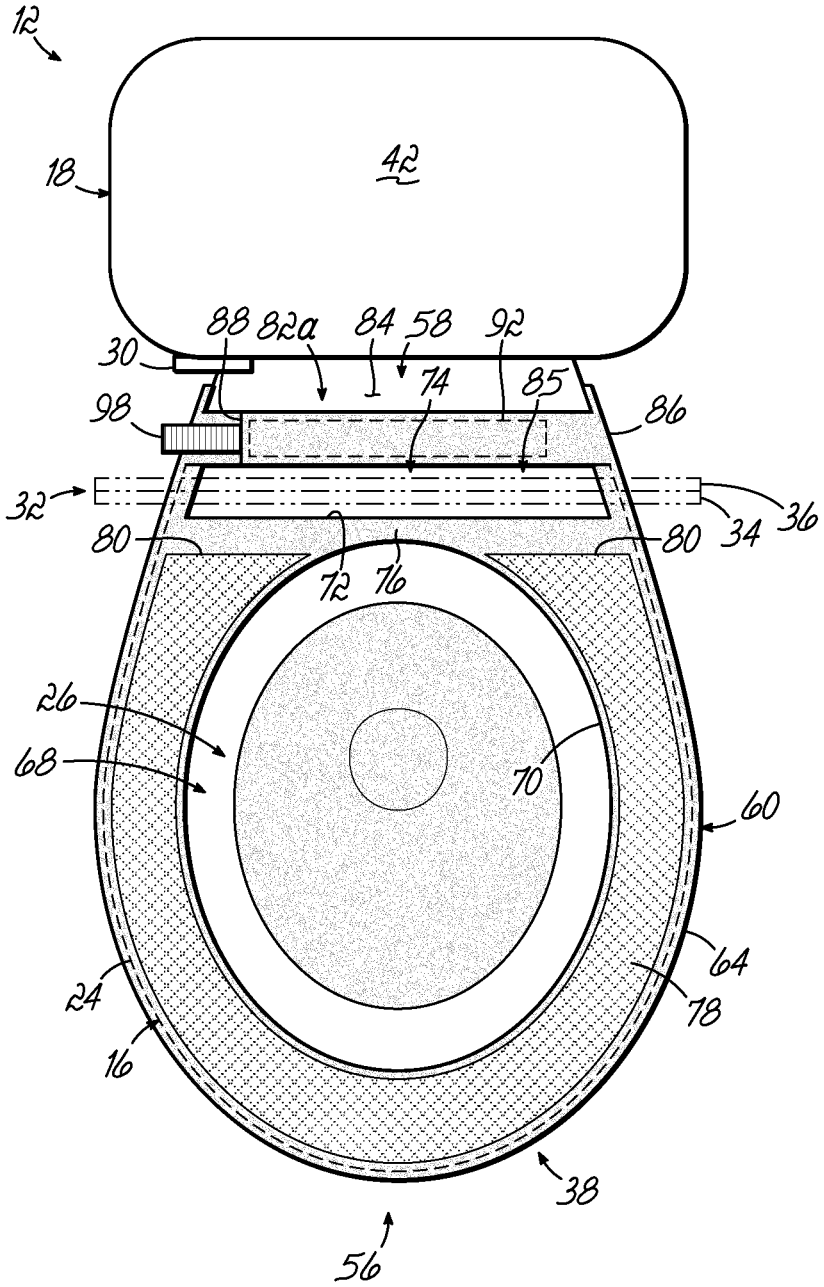

Referring now to FIGS. 2-3, an exemplary method of installing the bowl skirt 38 to the toilet 12 will now be described. To install the bowl skirt 38 to the toilet 12, the bowl skirt 38 is positioned over the toilet 12 with the attachment flaps 82*a*, 82*b* folded outward, as shown in FIG. 1. The bowl skirt 38 is lowered around the front 20 of the toilet 12, as indicated by directional arrow A1 if FIG. 1. Once lowered around the front 20 of the toilet 12, the first attachment strip 104 may be pressed into engagement with the second attachment strip 106 to attach the front 56 of the bowl skirt 38 to the front 20 of the toilet 12. When so positioned, the attachment flaps 82*a*, 82*b* may remain in an outward-folded position, as shown in FIG. 2A. To secure the back 58 of the bowl skirt 38 to the toilet 12, the pair of attachment flaps 82*a*, 82*b* are folded inward over the rear portion 84 of the rim 24. In that regard, the second attachment flap 82*b* is first folded inward over the rear portion 84 of the rim 24, as shown in FIG. 2B. Next, the first attachment flap 82*a* is folded inward to overlay the second attachment flap 82*b*. To that end, the attachment strip 92 of the first attachment flap 82*a* may be pressed into engagement with the attachment strip 96 of the second attachment flap 82*b* to couple the attachment flaps 82*a*, 82*b* together, as shown in FIG. 2C, to secure the back 58 of the bowl skirt 38 to the toilet 12, as shown in FIG. 3. The tank skirt 40, if used, may be installed to the toilet 12 before or after the bowl skirt 38.

Figure 4:
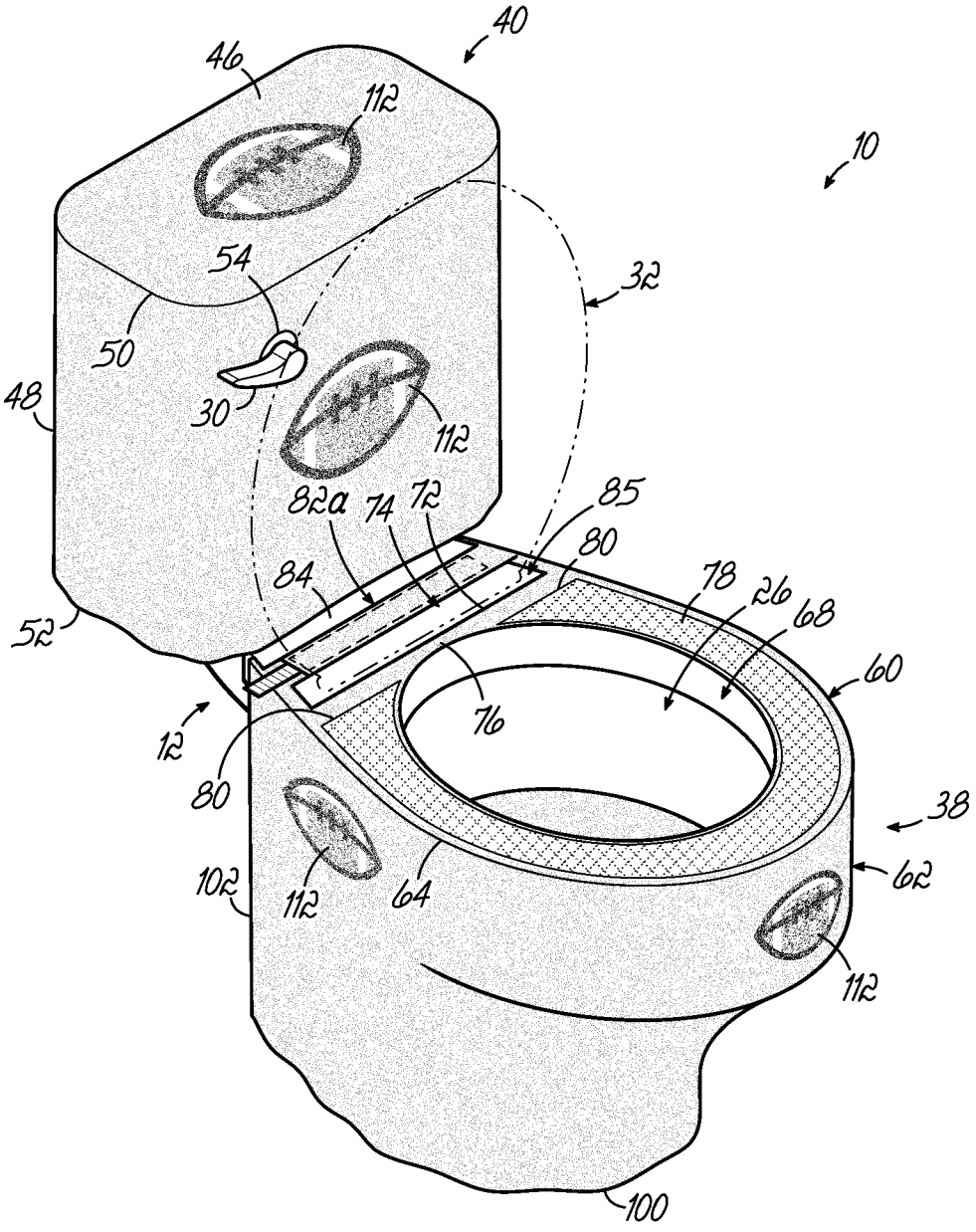
FIG. 4 is a front perspective view of a bowl skirt and a tank skirt of a hygienic cover ensemble in accordance with another embodiment of the present invention.

Referring now to FIG. 4, wherein like numerals represent like features compared to the embodiments described above with respect to FIGS. 1-3, the hygienic cover ensemble 10 is shown in accordance with another embodiment of the invention. In the embodiment shown in FIG. 4, the tank skirt 40 and the bowl skirt 38 may include on or more indicia 112, such as sports team logos, patterns, pictures, or other graphic or visual illustrations generally, for example. The indicia may correspond with other items in the bathroom, such as a shower curtain, rug(s), towel(s), and/or other items in the bathroom to improve the overall ambiance of the bathroom. With respect to the tank skirt 40, one or more indicia 112 may be located on the side sheet 48 and/or the top sheet 46. With respect to the bowl skirt 38, one or more logos may be located on the bowl cover portion 62.

While the invention has been illustrated by the description of various embodiments thereof, and while the embodiments have been described in considerable detail, it is not intended to restrict or in any way limit the scope of the appended claims to such detail. Thus, the various features discussed herein may be used alone or in any combination. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A hygienic cover ensemble for covering parts of a toilet, the hygienic cover ensemble comprising:

a tank skirt configured to encircle a water tank of the toilet; and a bowl skirt configured to removably envelop a bowl of the toilet, the bowl skirt comprising:

a rim cover configured to cover a rim of the bowl of the toilet, the rim cover being a single piece of material that extends continuously in an unbroken manner about the rim of the bowl of the toilet, the rim cover including a strip being configured to cover an area of the rim that is between a lid assembly of the toilet and a bowl opening to the bowl of the toilet;

a bowl cover that extends downwardly from a perimeter of the rim cover to cover a front portion of the bowl of the toilet; and at least one attachment flap spaced from the strip of the rim cover and connected to the bowl cover for rotation relative thereto, the at least one attachment flap being configured to removably secure the bowl skirt to the toilet, wherein the at least one attachment flap is configured to cover an area of the rim that is between the lid assembly of the toilet and the tank of the toilet, and wherein the at least one attachment flap includes a pair of attachment flaps that are configured to overlap in a lengthwise direction.

2. The hygienic cover ensemble of claim 1, wherein a slot is defined between the pair of attachment flaps and the strip of the rim cover, the slot being configured to accommodate the lid assembly of the toilet.

3. The hygienic cover ensemble of claim 1, wherein the bowl cover includes an open back to expose a back of the bowl of the toilet.

4. The hygienic cover ensemble of claim 1, wherein at least one attachment flap of the pair of attachment flaps includes an absorbent core.

5. The hygienic cover ensemble of claim 1, wherein the bowl skirt or the tank skirt include one or more indicia.

6. The hygienic cover ensemble of claim 1, wherein the bowl skirt and the tank skirt are reusable.

7. The hygienic cover ensemble of claim 1, wherein at least one attachment flap of the pair of attachment flaps includes a pull tab.

8. The hygienic cover ensemble of claim 1, wherein the tank skirt includes an opening to receive a flush mechanism of the toilet therethrough.

9. The hygienic cover ensemble of claim 1, wherein the bowl skirt includes a fastener configured to removably secure a portion of the bowl skirt to the bowl of the toilet.

10. The hygienic cover ensemble of claim 9, wherein the fastener is positioned on the bowl cover to removably secure a portion of the bowl cover to the front portion of the bowl of the toilet.

11. The hygienic cover ensemble of claim 1, wherein a portion of the rim cover includes an absorbent core.

12. The hygienic cover ensemble of claim 11, wherein the absorbent core extends circumferentially 50% or more about an inner edge of the rim cover.

13. The hygienic cover ensemble of claim 11, wherein the absorbent core terminates at a pair of ends adjacent a base edge of the rim cover.

14. A bowl skirt configured to removably envelop a bowl of a toilet, the bowl skirt comprising:

a rim cover configured to extend completely about so as to cover a rim of the bowl of the toilet, the rim cover being a single piece of material that extends continuously in an unbroken manner about the rim of the bowl of the toilet, the rim cover including a strip being configured to cover an area of the rim that is between a lid assembly of the toilet and a bowl opening to the bowl of the toilet;

a bowl cover that extends downwardly from a perimeter of the rim cover so as to extend about a front portion of the bowl of the toilet; and a pair of attachment flaps spaced from the strip of the rim cover and each being connected to the bowl cover for rotation relative thereto, the pair of attachment flaps being configured to overlap and connect to removably secure the bowl skirt to the toilet, the pair of attachment flaps being configured to overlap in a lengthwise direction to cover a rear portion of the rim between the lid assembly and a water tank of the toilet.

15. The bowl skirt of claim 14, wherein each of the pair of attachment flaps includes an absorbent core.

16. The bowl skirt of claim 14, wherein a portion of the rim cover includes an absorbent core.

17. The bowl skirt of claim 16, wherein the absorbent core extends circumferentially 50% or more about an inner edge of the rim cover.

18. The bowl skirt of claim 16, wherein the absorbent core terminates at a pair of ends adjacent a base edge of the rim cover.

19. A hygienic cover ensemble for covering parts of a toilet, the hygienic cover ensemble comprising:

a tank skirt configured to encircle a water tank of the toilet; and a bowl skirt configured to removably envelop a bowl of the toilet, the bowl skirt comprising:

a rim cover configured to cover a rim of the bowl of the toilet, the rim cover being a single piece of material that extends continuously in an unbroken manner about the rim of the bowl of the toilet, the rim cover including a strip being configured to cover an area of the rim that is between a lid assembly of the toilet and a bowl opening to the bowl of the toilet;

a bowl cover that extends downwardly from a perimeter of the rim cover to cover a front portion of the bowl of the toilet; and at least one attachment flap spaced from the strip of the rim cover and connected to the bowl cover for rotation relative thereto, the at least one attachment flap being configured to removably secure the bowl skirt to the toilet, wherein the at least one attachment flap is configured to cover an area of the rim that is between the lid assembly of the toilet and the tank of the toilet, and wherein the at least one attachment flap includes an absorbent core.

* * * * *